United States Patent [19]

Radowski

[11] 4,047,746

[45] Sept. 13, 1977

[54] ANIMAL WASTE REMOVING DEVICE

[76] Inventor: Stanley P. Radowski, 8410 Escanaba Ave., Chicago, Ill. 60617

[21] Appl. No.: 756,830

[22] Filed: Jan. 5, 1977

[51] Int. Cl.[2] ..... A46F 13/08

[52] U.S. Cl. ..... 294/55; 294/1 R; 294/19 R

[58] Field of Search ..... 294/55, 1 R, 19 R; 15/257.1, 257.7, 257.2, 257.4, 257.8; 150/1.8, 5, 2, 49; 119/1 R

[56] References Cited

U.S. PATENT DOCUMENTS

| | | | |
|---|---|---|---|
| 3,281,178 | 10/1966 | Fisher | 294/44 |
| 4,006,928 | 2/1977 | Beugin | 294/1 |

*Primary Examiner*—James B. Marbert

[57] ABSTRACT

An animal waste removing device, comprising a frame, and a bag having an open end and a closed end with a body portion therebetween and adapted to be removably supported by said frame with said open end adapted to receive therein the animal waste. The frame includes a handle at one end thereof including a pair of handle elements joined together at one end thereof, with an upper support rail extending transversely to the handle and having a concave configuration with one side of the open end of the bag draped thereon in supported position, and a lower support rail extending in substantially a horizontal plane in spaced relationship to the upper rail and transversely to the handle for supporting the other side of the open end of the bag with the body portion extending rearwardly thereof towards the handle. Coupling means for connecting the upper support rail and the lower support rail to the handle elements, such that the handle is positioned to have the open end of the bag in position to receive the waste therein is provided.

3 Claims, 2 Drawing Figures

ANIMAL WASTE REMOVING DEVICE

BACKGROUND OF THE INVENTION

The present invention is directed towards a trash or waste cleaning device, and in particular for picking up dog, or other litter.

The handling of refuse and litter created by pets in the metropolitan areas and especially on city streets is becoming more and more serious. Although a number of devices have been proposed, none seem to be readily acceptable for use by the dog owner to help maintain and remove the animal waste, to obtain streets free of the objectional waste material.

OBJECTS OF THE INVENTION

An object of the present invention is to provide an animal waste removing device having a bag that is easily disposed after each use of the device.

Another object of the present invention is to provide an animal waste removing device having a frame with a handle at one end thereof and having means at the other end thereof to support a bag to receive therein the animal waste.

Another object of the present invention is to provide an animal waste removing device having a frame that is light weight and made from wire and readily adapted to have a disposable bag mounted thereon.

Other objects and advantages of the present invention will become apparent as the disclosure proceeds.

SUMMARY OF THE INVENTION

An animal waste removing device, comprising a frame, and a bag having an open end and a closed end with a body portion therebetween and adapted to be removably supported by said frame with said open end adapted to receive therein the animal waste.

The frame includes a handle at one end thereof including a pair of handle elements joined together at one end thereof, with an upper support rail extending transversely to the handle and having a concave configuration with one side of the open end of the bag draped thereon in supported position, and a lower support rail extending in substantially a horizontal plane in spaced relationship to the upper rail and transversely to the handle for supporting the other side of the open end of the bag with the body portion extending rearwardly thereof towards the handle. Coupling means for connecting the upper support rail and the lower support rail to the handle elements, such that the handle is positioned to have the open end of the bag in position to receive the waste therein is provided.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
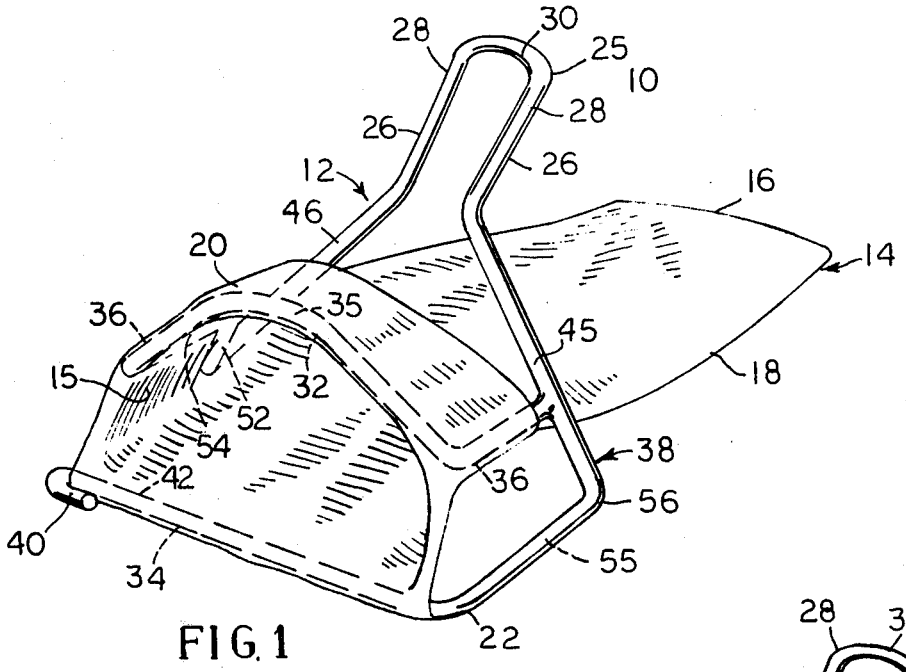
FIG. 1 is a perspective view of the animal waste removing device illustrating the frame and disposable bag in assembled relationship.
Figure 2:
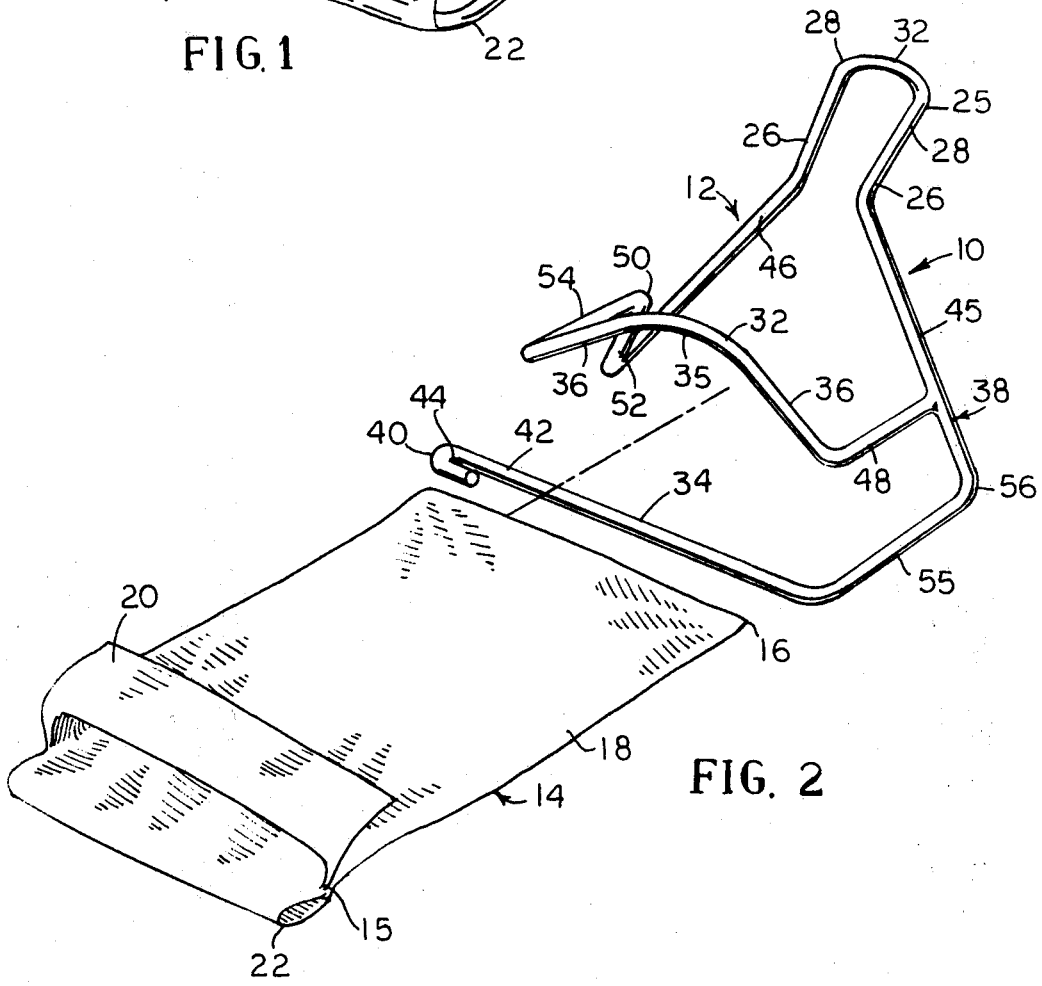
FIG. 2 is a perspective view similar to FIG. 1 illustrating the bag prior to assembly with the frame.

Referring to FIGS. 1 and 2, there is illustrated an animal waste removing device 10 that includes a frame 12 and a bag 14 having an open end 15 and a closed end 16 with a body portion 18 therebetween. The bag 14 is adapted to be removably supported by the frame 12 with the open end 15 adapted to receive therein the animal waste. As hereinafter explained, the bag 14 is easily secured to and removed from the frame 12 in a simple and convenient manner to encourage use of the device 10. The bag 14 may include an upper flap 20 and lower flap 22 that are adapted to extend over respective portions of the frame 12. The flaps 20 and 22 may be folded over each other when the bag 14 is discarded with the waste material therein. The waste material may be scooped up by the frame 12 or a broom or other implement may be utilized to push the waste material into the open end 15 of the bag 14. For example, a tongue depressor which is included with each plastic bag 14, and after being used, is disposed into the plastic bag 14.

The frame 12 includes a handle 25 at one end thereof including a pair of spaced apart handle elements 26 joined together at one end thereof 28 by connecting link 30. An upper support rail 32 and lower support rail 34 are utilized for supporting the bag 14 in the position of FIG. 1.

The upper support rail 32 extends transversely to the handle 25 and has a concave configuration at its central portion 35 and an inclined portion 36 at each end thereof. In the open position the bag 14 has the upper flap draped thereon. The lower support rail 34 extends in substantially a horizontal plane in spaced relationship to the upper rail 32 and transversely to the handle 25 for supporting the other side of the open end 15 of the bag 14 with the body portion extending rearwardly thereof towards the handle 25.

Coupling means 38 is utilized for connecting the upper support rail 32 and lower support rail 34 to the handle elements 26. In this manner the handle 25 is positioned to have the open end 15 of the bag 14 adapted to receive the waste material therein. The frame 12 may be formed from a wire and bent to the desired configuration, or made from plastic and injection molded. The lower rail 34 includes a finger or element 40 at one end 42 thereof. The finger 40 extends in parallel spaced relationship to the lower rail 34 to define a groove or channel 44 therebetween for receiving one end of the open end 15 of the bag 14. This groove 42 helps maintain the bag 14 in releasably fixed position to the lower frame 34.

The coupling means 38 includes a pair of downwardly extending arms 45 and 46 connected respectively at one end thereof to the handle elements 26. A first leg 48 connects arm 45 to one end 36 of the upper support rail 32. A second leg 50 connects one end of arm 46 to the opposite end 36 of the upper support rail 32. The second leg 50 includes a substantially vertically extending leg portion 52 and a substantially horizontally extending coupling member 54 connected to the upper support rail 32.

As illustrated in FIG. 2 a spacing is defined between the lower support rail 34 at the end having the finger 40 and the end of the upper support rail 32 having the second leg 50. This spacing permits the bag 14 to be readily slid into position sideways if so desired. It also permits the bag 14 to be removed between the defined space. The coupling means 38 further includes a lower connecting element 55 extending rearwardly from the end of the lower rail 34 spaced from the finger 40 and connected to arm 45 at juncture 56 to maintain the frame 12 in a planar surface with the bag 14 mounted thereon. The arms 45 and 46 converge outwardly from the handle elements 26 to provide the spacing for defining the open end 15 of the bag 14. The lower connecting element 55 and leg 48 extend forwardly from arm 45 and are in substantially vertically spaced relationship to each other.

As described above the frame 12 may be supplied with a number of bags 14, and each bag 14 readily assembled with the frame 12 in order to accomplish the intended waste disposal purpose of the device 10. The bag 14 is readily removed from the frame 12 and disposed of with the contents therein.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

I claim:

1. An animal waste removing device, comprising:

a. a frame, and b. a bag having an open end and a closed end with a body portion therebetween and adapted to be removably supported by said frame with said open end adapted to receive therein the animal waste, c. said frame including:

1. a handle at one end thereof including a pair of handle elements joined together at one end thereof,
2. an upper support rail extending transversely to said handle and having a concave configuration with one side of the open end of said bag draped thereon in supported position,
3. a lower support rail extending in substantially a horizontal plane in spaced relationship to said upper rail and transversely to said handle for supporting the other side of said open end of said bag with said body portion extending rearwardly thereof towards said handle,
4. coupling means for connecting said upper support rail and said lower support rail to said handle elements, such that said handle is positioned to have said open end of said bag in position to receive the waste therein,
5. said coupling means includes a pair of downwardly extending arms connected respectively at one end thereof to said handle elements, and a first leg and a second leg, each said leg connected at one end thereof to said arms, and at the other end thereof to each end of said upper support rail,
6. said second leg includes a substantially vertically extending leg portion and a substantially horizontally extending coupling member connected to said upper support rail at one end thereof such that said bag is adapted to be removed between the space defined between said coupling member and said lower suppport rail,
7. a lower connecting element extending rearwardly from one end of said lower rail and connected to one of said arms to maintain said frame in a planar surface with said bag mounted thereon, said arms converge outwardly from said handle elements to provide the spacing for defining the open end of said bag, and
8. said first leg and said lower connecting element extend forwardly from one of said arms and are in substantially vertically spaced relationship to each other, and d. means for retaining said bag in releasably fixed position to said lower rail, said means includes a finger at one end thereof extending in parallel spaced relationship to said lower rail to define a groove therebetween adapted to receive therein one end of said open end of said bag.

2. The device as in claim 1, wherein said frame is of a wire form.

3. The device as in claim 1, wherein said bag has an upper flap at said open end to be enclosed over said uppper support rail and a lower flap at said open end adapted to be received over said lower support rail.

* * * * *